US010326218B2

(12) United States Patent
Hirooka et al.

(10) Patent No.: US 10,326,218 B2
(45) Date of Patent: Jun. 18, 2019

(54) ELECTRIC WIRE MODULE

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Toshiya Hirooka, Mie (JP); Daisuke Hashimoto, Mie (JP); Yuichi Kimoto, Mie (JP)

(73) Assignees: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 0 days.

(21) Appl. No.: 15/573,530

(22) PCT Filed: Apr. 25, 2016

(86) PCT No.: PCT/JP2016/062891
§ 371 (c)(1),
(2) Date: Nov. 13, 2017

(87) PCT Pub. No.: WO2016/181809
PCT Pub. Date: Nov. 17, 2016

(65) Prior Publication Data

US 2018/0123265 A1 May 3, 2018

(30) Foreign Application Priority Data

May 14, 2015 (JP) ..... 2015-098766

(51) Int. Cl.
*H01R 4/02* (2006.01)
*H01R 4/18* (2006.01)
(Continued)

(52) U.S. Cl.
CPC ..... *H01R 4/60* (2013.01); *H01R 4/72* (2013.01); *H01R 13/562* (2013.01); *H01R 4/021* (2013.01);
(Continued)

(58) Field of Classification Search
CPC ..... H01R 11/12; H01R 4/60; H01R 4/72
See application file for complete search history.

(56) References Cited

U.S. PATENT DOCUMENTS 1,751,405 A * 3/1930 Herman ..... H01R 11/12 29/461
2,286,097 A * 6/1942 Johnson ..... H01R 4/183 29/505
(Continued)

FOREIGN PATENT DOCUMENTS

JP S63143862 U 9/1988
JP H08203585 A 8/1996
(Continued)

OTHER PUBLICATIONS

International Search Report for Application No. PCT/JP2016/062891 dated Jul. 19, 2016; 4 pages.

*Primary Examiner* — Timothy J Thompson
*Assistant Examiner* — Rhadames Alonzo Miller
(74) *Attorney, Agent, or Firm* — Reising Ethington, P.C.

(57) ABSTRACT

In the case of connecting a flexible conductive member to a single-core wire, the single-core wire and the flexible conductive member are connected more easily, without crushing the single-core wire. An electrical wire module includes: a first conductive portion that is a single-core wire; a second
(Continued)

conductive portion that is tube-shaped and more flexible than the first conductive portion, one end portion of the second conductive portion is connected to an end portion of the first conductive portion in a state of covering the outer circumferential surface thereof; a connection portion that is electrically conductive, is connected to an other end portion of the second conductive portion, and includes a portion that is terminal-shaped and can be connected to a partner member; and an insulating covering portion that surrounds at least the first conductive portion and the second conductive portion.

5 Claims, 3 Drawing Sheets

(51) Int. Cl.
*H01R 4/60* (2006.01)
*H01R 4/72* (2006.01)
*H01R 11/12* (2006.01)
*H01R 13/56* (2006.01)

(52) U.S. Cl.
CPC ..... *H01R 4/029* (2013.01); *H01R 4/183* (2013.01); *H01R 11/12* (2013.01)

(56) References Cited

U.S. PATENT DOCUMENTS 5,349,131 A * 9/1994 Sotani ..... H01F 27/18 174/24
5,541,380 A * 7/1996 Ogden ..... H01R 11/12 219/56
5,971,819 A * 10/1999 Prat ..... B64D 45/02 439/874
6,583,352 B2 * 6/2003 Fukushima ..... H01R 9/032 174/373
2002/0002004 A1 * 1/2002 Akama ..... H01R 12/62 439/625
2002/0043882 A1 4/2002 Tanaka et al.
2003/0049956 A1 * 3/2003 Yoshida ..... H01R 9/0518 439/98
2003/0062177 A1 * 4/2003 Yagi ..... H01R 9/032 174/359
2003/0119351 A1 * 6/2003 Miyazaki ..... H01R 9/032 439/271
2003/0236016 A1 * 12/2003 Murakami ..... H01B 7/0081 439/212
2009/0093159 A1 * 4/2009 Aoki ..... H01R 9/032 439/607.41
2009/0294149 A1 * 12/2009 Watanabe ..... H01B 7/16 174/102 R
2011/0146072 A1 * 6/2011 Biesse ..... H01R 9/032 29/887
2011/0318960 A1 * 12/2011 Koga ..... H01R 4/185 439/585
2012/0292101 A1 * 11/2012 Kato ..... H01R 13/5208 174/72 A
2012/0318575 A1 * 12/2012 Koto ..... H01R 4/72 174/84 C
2013/0023158 A1 * 1/2013 Kato ..... H01R 43/24 439/625
2013/0126234 A1 * 5/2013 Ono ..... H01R 4/72 174/75 R
2014/0008122 A1 * 1/2014 Imahori ..... H01B 17/308 174/77 R
2014/0216812 A1 * 8/2014 Adachi ..... B60R 16/0215 174/72 A
2014/0284100 A1 * 9/2014 Ichikawa ..... B60R 16/0215 174/70 R
2014/0284102 A1 * 9/2014 Ichikawa ..... B60R 16/0215 174/72 A
2015/0187469 A1 * 7/2015 Inao ..... H02G 3/0481 29/863
2015/0244159 A1 * 8/2015 Seifert ..... H02G 15/04 174/77 R
2016/0380390 A1 * 12/2016 Kusamaki ..... H01R 9/034 439/607.44
2018/0019549 A1 * 1/2018 Makido ..... H01R 13/5205

FOREIGN PATENT DOCUMENTS

JP 2002136019 A 5/2002
JP 2009199892 A 9/2009

* cited by examiner

ELECTRIC WIRE MODULE

CROSS REFERENCE TO RELATED APPLICATIONS

This application claims the priority of Japanese patent application JP2015-098766 filed on May 14, 2015, the entire contents of which are incorporated herein.

TECHNICAL FIELD

The present invention relates to an electrical wire module that connects devices to each other.

BACKGROUND ART

In wire harnesses for installation in a vehicle such as an automobile, there are cases where the applied electrical wire module that connects two devices includes a relatively rigid single-core wire and a relatively flexible stranded wire. In such a case, the electrical wire module relatively maintains its shape in the single-core wire portion, but bends relatively flexibly in the stranded wire portion.

For example, Patent Document 1 (JP S64-143862U) shows an example of an electrical wire module in which an end portion of a single-core wire is given a flat plate shape, and an end portion of a stranded wire is welded to the flat plate-shaped portion.

SUMMARY

However, in the example shown in Patent Document 1, processing for crushing the end portion of the single-core wire into a flat plate shape for connectability with the stranded wire is performed before welding the single-core wire and the stranded wire. For this reason, connection work is troublesome.

An object of the present application is to provide technology in which, in the case of connecting a flexible conductive member to a single-core wire, the single-core wire and the flexible conductive member are connected more easily.

An electrical wire module according to a first aspect includes: a first conductive portion that is a single-core wire; a second conductive portion that is tube-shaped and more flexible than the first conductive portion, one end portion of the second conductive portion being connected to an end portion of the first conductive portion in a state of covering an outer circumferential surface of the end portion of the first conductive portion; a connection portion that is electrically conductive, is connected to an other end portion of the second conductive portion, and includes a terminal-shaped portion capable of being connected to a partner member; and an insulating covering portion that surrounds at least the first conductive portion and the second conductive portion.

An electrical wire module according to a second aspect is an aspect of the electrical wire module according to the first aspect. In the electrical wire module according to the second aspect, the connection portion includes a first connection portion that is bar-shaped and includes a portion connected to the other end portion of the second conductive portion in a state where an outer circumferential surface is covered by the other end portion, and a second connection portion that is terminal-shaped and is formed on a side of the first connection portion that is opposite to a second conductive portion side.

An electrical wire module according to a third aspect is an aspect of the electrical wire module according to the second aspect. In the electrical wire module according to the third aspect, the connection portion is formed by processing a single-core wire that is separate from the first conductive portion, and the connection portion includes the first connection portion that is one end portion of the separate single-core wire, the second connection portion that is an other end portion of the separate single-core wire that is terminal-shaped, and an intermediate portion that is a portion other than the two end portions of the separate single-core wire and connects the first connection portion and the second connection portion.

An electrical wire module according to a fourth aspect is an aspect of the electrical wire module according to the third aspect. In the electrical wire module according to the fourth aspect, the insulating covering portion is a member in which a heat shrink tube is shrunk so as to surround the first conductive portion, the second conductive portion, and the first connection portion and the intermediate portion of the connection portion.

An electrical wire module according to a fifth aspect is an aspect of the electrical wire module according to any one of the first to fourth aspects. In the electrical wire module according to the fifth aspect, the second conductive portion is a braided wire obtained by braiding a plurality of strands into a tubular shape.

In the above aspects, the second conductive portion, which is tube-shaped and more flexible than the first conductive portion that is a single-core wire, is connected in the state of surrounding the end portion of the first conductive portion. In this case, the single-core wire does not need to be subjected to crush processing in order to provide the single-core wire with a connection portion for connection to a flexible member. Accordingly, the single-core wire (first conductive portion) and the flexible conductive member (second conductive portion) can be connected more easily.

Also, in the second aspect, the connection portion includes the first connection portion that is bar-shaped and includes the portion connected to the other end portion of the second conductive portion in the state where the outer circumferential surface of the portion is covered by the other end portion, and the second connection portion that is terminal-shaped and is formed on the side of the first connection portion that is opposite to the second conductive portion side. In this case, the second conductive portion and the connection portion can be connected by an operation similar to that for connecting the first conductive portion and the second conductive portion.

Also, in the third aspect, the connection portion includes the first connection portion that is one end portion of the separate single-core wire, the second connection portion that is the other end portion of the separate single-core wire that is terminal-shaped, and the intermediate portion that is the portion other than the two end portions of the separate single-core wire and is a shape-maintaining portion having a rigidity capable of maintaining a shape conforming to a routing path. In this case, the connection portion can be produced using a single-core wire.

Also, in the fourth aspect, the insulating covering portion is a member in which a heat shrink tube is shrunk so as to surround the first conductive portion, the second conductive portion, and the first connection portion and the intermediate portion of the connection portion. In this case, the operation of providing the insulating covering portion can be performed easily.

Also, in the fifth aspect, the second conductive portion is a braided wire obtained by braiding a plurality of strands into a tubular shape. In this case, the tube-shaped braided wire is more flexible, thus making it possible to absorb more vibration.

DESCRIPTION OF EMBODIMENTS

Figure 1:
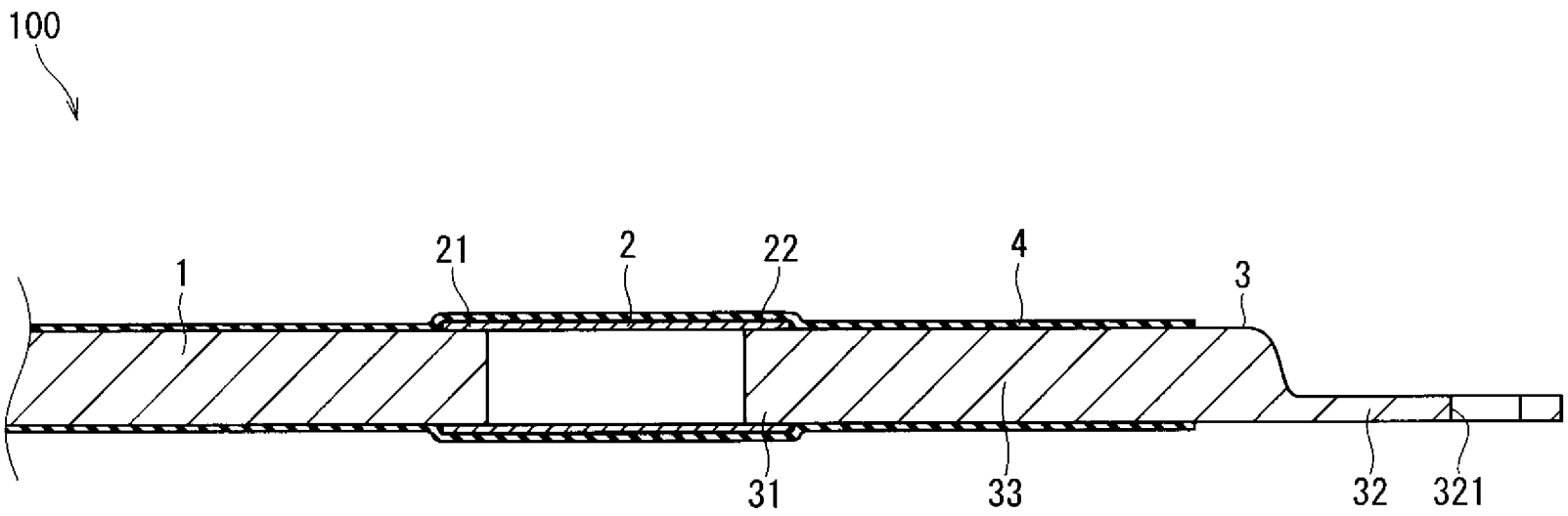
FIG. 1 is a cross-sectional view of an electrical wire module according to an embodiment.

Hereinafter, an embodiment will be described with reference to the accompanying drawings. The following embodiment is an example of an embodiment of the present invention, and is not intended to limit the technical scope of the present invention.

An electrical wire module 100 according to the present embodiment will be described below with reference to FIGS. 1 to 4. The electrical wire module 100 includes a first conductive portion 1, a second conductive portion 2, a connection portion 3, and an insulating covering portion 4. The electrical wire module 100 is for installation in a vehicle such as an automobile. The electrical wire module 100 is a member that connects two devices installed in the vehicle, for example.

Figure 2:
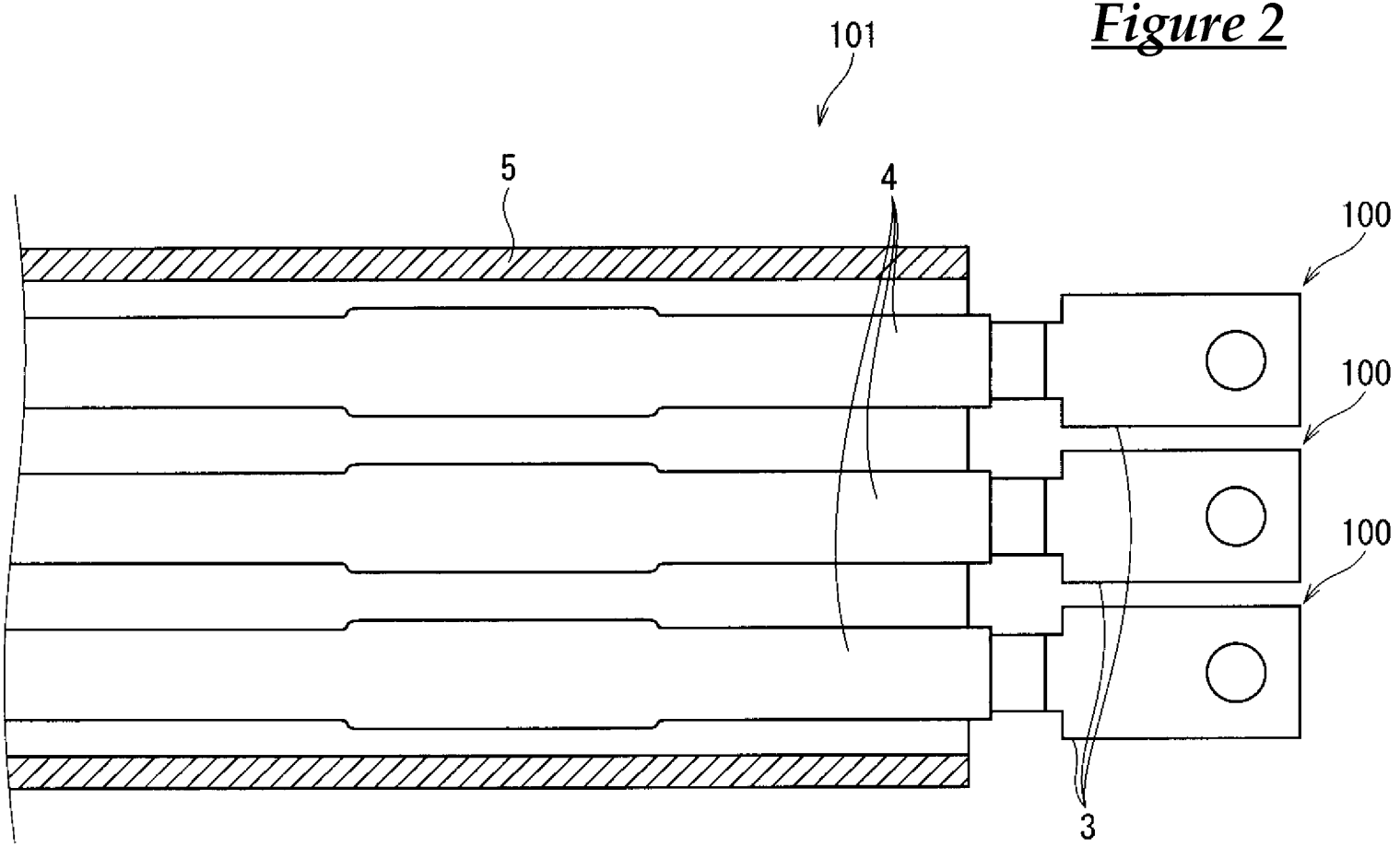
FIG. 2 is a partial cutaway plan view of a wire harness that includes the electrical wire module according to the embodiment.
Figure 3:
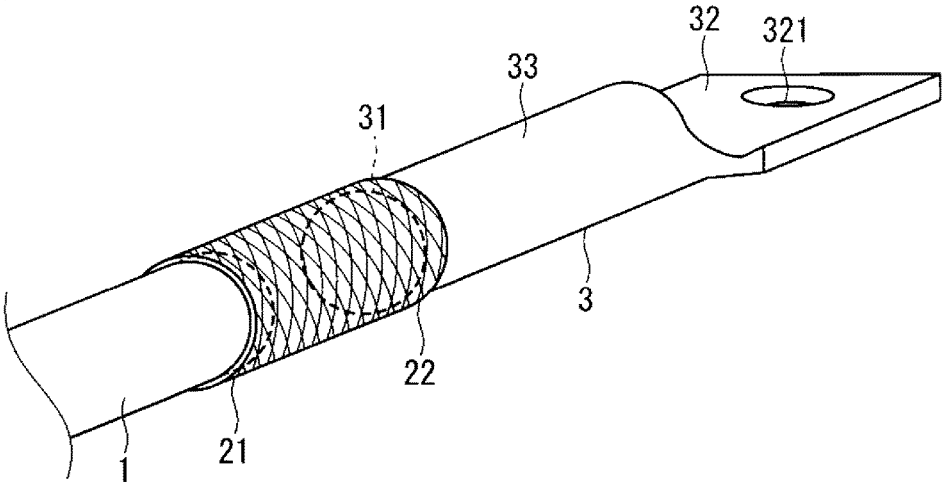
FIG. 3 is a perspective view of the electrical wire module according to the embodiment, with some portions omitted.
Figure 4:
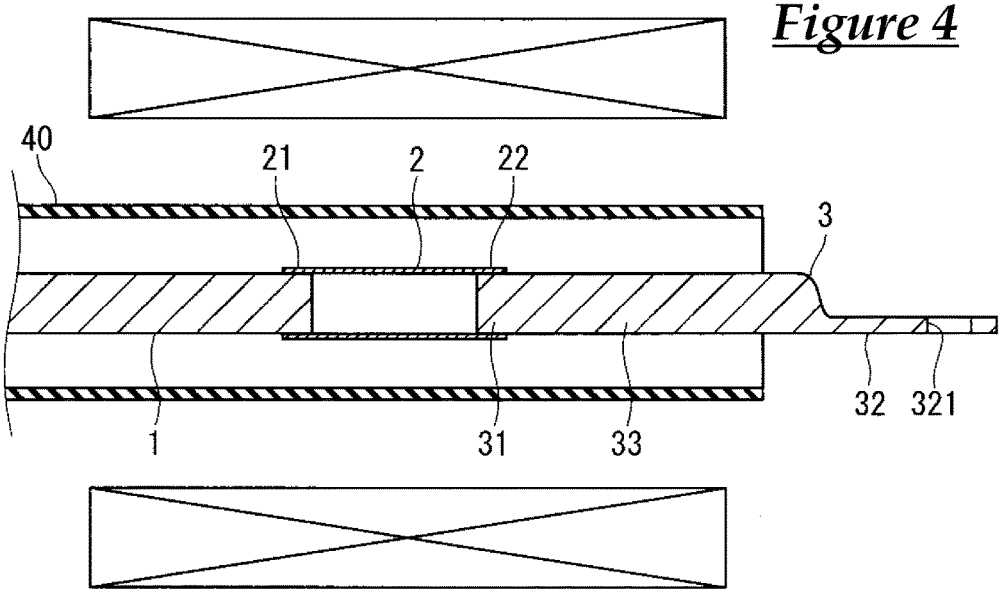
FIG. 4 is a diagram showing the provision of an insulating covering portion of the electrical wire module according to the embodiment.

FIG. 1 is a cross-sectional view of the electrical wire module 100. The cross-sectional view in FIG. 1 is taken along a cutting plane line that extends along the extending direction of the electrical wire module 100. FIG. 2 is a partial cutaway plan view of a wire harness 101 that includes three electrical wire modules 100 and a shield body 5 that covers all three of the electrical wire modules 100. In FIG. 2, the interior of the shield body 5 has been cut away. FIG. 3 is a perspective view of the electrical wire module 100, with some portions omitted. In FIG. 3, the insulating covering portion 4 has been omitted from the electrical wire module 100. FIG. 4 is a cross-sectional view showing the provision of the insulating covering portion 4 in the electrical wire module 100. Note that the cross-sectional view in FIG. 4 is taken along a cutting plane line that extends along the extending direction of the electrical wire module 100.

The electrical wire module 100 connects an inverter apparatus and a motor, for example. In this case, it is thought that AC electricity flows through the first conductive portion 1, the second conductive portion 2, and the connection portion 3 in the electrical wire module 100.

Also the electrical wire module 100 may connect a device arranged in front of the vehicle compartment to a device arranged behind the vehicle compartment, for example. In this case, it is thought that the electrical wire module 100 is attached so as to extend under the floor between the two devices installed in the vehicle, for example. Note that an inverter apparatus may be the device arranged in front of the vehicle compartment, for example. Also, a battery may be the device arranged behind the vehicle compartment, for example. In such a case, it is thought that DC electricity flows through the first conductive portion 1, the second conductive portion 2, and the connection portion 3 in the electrical wire module 100.

Also, the wire harness 101 includes the shield body 5 that is made of a metal and surrounds the electrical wire modules 100. In this case, electromagnetic noise is blocked by the shield body provided around the electrical wire modules 100. The following shows the case where three electrical wire modules 100 are inserted into the shield body 5. However, one, two, or four or more electrical wire modules 100 may be inserted into the shield body 5.

Note that the shield body 5 may be a metal pipe obtained by forming a metal such as aluminum or copper into a tubular shape, a braided wire obtained by braiding strands into a tubular shape, or the like.

The following describes the first conductive portion 1, the second conductive portion 2, connection portion 3, and the insulating covering portion 4 of the electrical wire module 100. First, the first conductive portion 1 will be described.

As shown in FIGS. 1 and 2, the first conductive portion 1 of the electrical wire module 100 is a single-core wire. For this reason, the first conductive portion 1 of the electrical wire module 100 is a portion that has a relatively high rigidity. In other words, the first conductive portion 1 is more rigid than the later-described second conductive portion 2.

Also, the first conductive portion 1 may be routed along a bent path, a straight path, or a path that includes both a bent path and a straight path. For example, in the case where the first conductive portion 1 is routed along a bent path, the first conductive portion 1 may be subjected to bending processing and maintain the bent shape. Accordingly, in this case, the first conductive portion 1 may have rigidity capable of maintaining a shape that conforms to the routing path of the electrical wire module 100.

More specifically, the first conductive portion 1 may have rigidity according to which the shape thereof does not change due to vehicle vibration when installed in a vehicle, for example. In other words, the first conductive portion 1 may have rigidity to the extent of not losing a straight or bent shape due to vehicle vibration when installed in a vehicle.

Also, in the present embodiment, the first conductive portion 1 may be, for example, a bar-shaped metal member whose main component is aluminum, copper, or the like.

Also, in the present embodiment, the first conductive portion 1 has a solid circular shape in a cross-section taken along a cutting plane line that is orthogonal to the extending direction of the first conductive portion 1. In other words, the first conductive portion 1 is shaped as a circular column. However, the cross-sectional shape of the first conductive portion 1 may be a shape other than a circle, such as a rounded-corner quadrangle. Note that it is preferable that the outer circumferential surface of the first conductive portion 1 is entirely a smooth curved surface, or includes a plurality of flat surfaces and curved surfaces that connect the flat surfaces. In other words, it is preferable that that the outer circumferential surface of the first conductive portion 1 does not have angular portions. This configuration is for making it unlikely for a load to be applied to the second conductive portion 2 that is connected in a state of covering the outer circumferential surface of the first conductive portion 1. However, the outer circumferential surface of the first conductive portion 1 may have an angular portion.

Next, the second conductive portion 2 will be described. The second conductive portion 2 of the electrical wire module 100 is tube-shaped and more flexible than the first conductive portion 1. For example, the second conductive portion 2 may be formed with flexibility for being capable of extending, contracting, and bending due to vehicle vibration. Note that in the present embodiment, the second conductive portion 2 is a braided wire obtained by braiding strands into a tubular shape.

Also, in the present embodiment, the second conductive portion 2 may be, for example, a braided wire obtained by braiding metal strands, whose main component is aluminum, copper, or the like, into a tubular shape. However, the second conductive portion 2 may be a member obtained by bending a thin plate-shaped metal member into a tubular shape, for example.

In the electrical wire module 100, one end portion 21 of the second conductive portion 2 is connected to the first conductive portion 1 in a state of covering the outer circumferential surface of the end portion of the first conductive portion 1. Note that the later-described connection portion 3 is connected to an other end portion 22 of the second conductive portion 2.

In the present embodiment, the second conductive portion 2 and the first conductive portion 1 are connected by using ultrasonic welding or the like to weld the one end portion 21 of the second conductive portion 2 in the state of covering the end portion of the first conductive portion 1. Note that the first conductive portion 1 and the second conductive portion 2 may be connected by crimping a ring-shaped crimping member around the second conductive portion 2 in the state where the one end portion 21 of the second conductive portion 2 covers the end portion of the first conductive portion 1. Also, connection may be performed by soldering the one end portion 21 of the second conductive portion 2 in the state of covering the end portion of the first conductive portion 1.

Next, the connection portion 3 will be described. The connection portion 3 is an electrically conductive member. The connection portion 3 includes a terminal-shaped portion that is connected to the other end portion 22 of the second conductive portion 2 and is capable of being connected to a partner member. Note that the term partner member refers to the member to which the electrical wire module 100 is to be connected.

Also, in the present embodiment, the case is described in which the connection portion 3 is formed by processing a single-core wire that is separate from the first conductive portion 1. Note that in this case, the connection portion 3 includes a first connection portion 31, a second connection portion 32, and an intermediate portion 33.

In the present embodiment, the first connection portion 31 includes a portion that is connected to the other end portion 22 of the second conductive portion 2 in the state where the outer circumferential surface is covered by the other end portion 22. For example, the first connection portion 31 and the second conductive portion 2 may be connected by welding. However, the first connection portion 31 and the second conductive portion 2 may be connected by a crimping member such as a crimp ring, for example.

Note that in the present embodiment, the first connection portion 31 is one end portion of a separate single-core wire. More specifically, the first connection portion 31 is an end portion of the shape-maintaining portion of a round bar-shaped separate single-core wire. For this reason, it is thought that the first connection portion 31 has a round shape in a cross-section taken along a cutting plane line that is orthogonal to the extending direction of the connection portion 3. However, the cross-sectional shape of the first connection portion 31 may be a shape other than a circle, such as a rounded-corner quadrangle.

Next, the second connection portion 32 will be described. The second connection portion 32 is formed on the side of the first connection portion 31 that is opposite to the second conductive portion 2 side. In other words, the second connection portion 32 is formed continuously with the side of the first connection portion 31 that is opposite to the second conductive portion 2 side. The second connection portion 32 is the portion that can be connected to a partner member. In this case, the second connection portion 32 is the portion in which the other end portion of the separate single-core wire has a terminal shape. Note that in the example shown in FIGS. 1 and 2, the second connection portion 32 is shaped as a flattened terminal.

Also, in the present embodiment, a bolt hole 321 that enables bolt fastening to a partner member is formed in the second connection portion 32. The bolt hole 321 is a through-hole that penetrates from one main surface of the second connection portion 32 to the other main surface.

Next, the intermediate portion 33 will be described. The intermediate portion 33 is the portion of the separate single-core wire that excludes the two end portions thereof, and is the portion that connects the first connection portion 31 and the second connection portion 32. In this case, the intermediate portion 33 is the portion other than the end portions of the shape-maintaining portion of the round bar-shaped separate single-core wire. Accordingly, the intermediate portion 33 is a portion that can maintain its shape and has a rigidity capable of maintaining a shape conforming to the routing path. For this reason, it is thought that, similarly to the first connection portion 31, the intermediate portion 33 has a round shape in a cross-section taken along a cutting plane line that is orthogonal to the extending direction of the connection portion 3. Note that the cross-sectional shape of the intermediate portion 33 may be a shape other than a circle, such as a rounded-corner quadrangle.

Next, the insulating covering portion 4 will be described. In the electrical wire module 100, the insulating covering portion 4 surrounds at least the first conductive portion 1 and the second conductive portion 2. Note that here, the insulating covering portion 4 surrounds the first conductive portion 1, the second conductive portion 2, and the first connection portion 31 and the intermediate portion 33 of the connection portion 3.

The insulating covering portion 4 may be a member that is made of an insulating resin. In the present embodiment, the insulating covering portion 4 is a member in which a heat shrink tube 40 is shrunk so as to surround the first conductive portion 1, the second conductive portion 2, and the first connection portion 31 and the intermediate portion 33 of the connection portion 3. The heat shrink tube 40 is a tube-shaped member made of a synthetic resin that is polyurethane based, nylon based, silicone based, fluororesin based, or polyester elastomer based, for example. The heat shrink tube 40 can be obtained by molding a resin member into the shape of a very narrow tube by extrusion molding, stretching the resin member into a wide tube shape in a heated state, and then cooling the resin member. The heat shrink tube 40 obtained in this way has a shape-memory property of, when heated, shrinking to the thin tube shape it had before being stretched.

Accordingly, in the present embodiment, the insulating covering portion 4 may be provided according to the following procedure, for example. First, the one end portion 21 of the second conductive portion 2 is connected to an end portion of the first conductive portion 1 in the bare wire state, and the first connection portion 31 of the connection portion 3 is connected to the other end portion 22 of the second conductive portion 2. Next, as shown in FIG. 4, the heat shrink tube 40 is arranged so as to surround the first conductive portion 1, second conductive portion 2, and the connection portion 3 in the connected state. Then the heat shrink tube 40 is heated so as to shrink, thus obtaining the insulating covering portion 4 that surrounds the first conductive portion 1, the second conductive portion 2, and the first connection portion 31 and the intermediate portion 33 of the connection portion 3.

Note that as another aspect, the first conductive portion 1 and the connection portion 3 may each be an insulated electrical wire that includes a single-core wire and an insulating covering formed around the single-core wire by extrusion molding. In this case, the insulating covering portion 4 may include an insulating covering that is formed around the first conductive portion 1 and the connection portion 3 by extrusion molding. Note that in this case, a configuration is possible in which the insulating covering is removed from the end portion of the first conductive portion 1 and the first connection portion 31 of the connection portion 3, and these portions are connected to the second conductive portion 2.

Also, as another aspect, the insulating covering portion 4 may be a tape-like member or sheet-like member that is wrapped so as to surround the first conductive portion 1, the second conductive portion 2, and the first connection portion 31 and the intermediate portion 33 of the connection portion 3, for example.

In the present embodiment, the electrical wire module 100 connects two devices that are installed in a vehicle, for example. In this case, the second conductive portion 2 of the electrical wire module 100 is provided at at least one location between the two devices. Accordingly, vibration is absorbed by the flexible second conductive portion 2, and breakage caused by vibration is suppressed. For example, the second conductive portion 2 may be provided at one location in a central portion between the two devices. In this case, the end portion of the first conductive portion 1 on the side opposite to the second conductive portion 2 side may be terminal-shaped similarly to the connection portion 3. Note that the second conductive portion 2 may of course be provided at two or more locations.

Also, in the present embodiment, the second conductive portion 2, which is tube-shaped and more flexible than the first conductive portion 1 that is a single-core wire, is connected in the state of surrounding the end portion of the first conductive portion 1. In this case, the single-core wire does not need to be subjected to crush processing in order to provide the single-core wire with a connection portion for connection to a flexible member. Accordingly, the single-core wire (first conductive portion 1) and the flexible conductive member (second conductive portion 2) can be connected more easily.

Also, in the present embodiment, the connection portion 3 includes: the bar-shaped first connection portion 31 that includes a portion that is connected to the other end portion 22 of the second conductive portion 2 in the state where the outer circumferential surface is covered by the other end portion 22; and the second connection portion 32 that is terminal-shaped, is formed on the side of the first connection portion 31 that is opposite to the second conductive portion 2 side, and can be electrically connected to a partner member. In this case, the second conductive portion 2 and the connection portion 3 can be connected by an operation similar to that for connecting the first conductive portion 1 and the second conductive portion 2.

Also, in the present embodiment, the first connection portion 31 is a portion other than the end portion of a single-core wire that is separate from the first conductive portion 1, the portion being a shape-maintaining portion and having a rigidity capable of maintaining a shape conforming to a routing path, and the second connection portion 32 is an end portion of the separate single-core wire and is terminal-shaped. In this case, the connection portion 3 can be produced using a single-core wire.

Also, in the present embodiment, the second conductive portion 2 is a braided wire obtained by braiding strands into a tubular shape. In this case, the tube-shaped braided wire is more flexible, thus making it possible to absorb more vibration.

Also, in the present embodiment, the insulating covering portion 4 is a member in which the heat shrink tube 40 is shrunk so as to surround the first conductive portion 1, the second conductive portion 2, and the first connection portion 31 and the intermediate portion 33 of the connection portion 3. In this case, the operation of providing the insulating covering portion 4 can be performed easily.

Hereinafter, application examples of the electrical wire module will be described. For example, in the electrical wire module 100, the connection portion 3 may be a terminal.

Also, the second conductive portion 2 may be connected to the connection portion 3 without surrounding the connection portion 3. For example, a configuration is possible in which a portion of the connection portion 3 is given a flat plate shape, and the second conductive portion 2 is connected to one surface of the flat plate-shaped portion by welding.

Also, the second connection portion 32 of the connection portion 3 may be bar-shaped or a cavity that extends in the extending direction of the connection portion 3, for example. In other words, the second connection portion 32 may have a so-called male terminal shape or a female terminal shape.

Note that in the electrical wire module according to the present invention, the embodiments and application examples described above can be freely combined, and modifications or partial omissions may be appropriately applied to the embodiments and application examples, within the scope of the invention described in the claims.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

REFERENCE SIGNS LIST

1 First conductive portion
100 Electrical wire module
2 Second conductive portion
21 One end portion
22 Other end portion
3 Connection portion
31 First connection portion
32 Second connection portion
33 Intermediate portion
4 Insulating covering portion
40 Heat shrink tube

The invention claimed is:

1. An electrical wire module comprising:

a first conductive portion that is a single-core wire and includes an end portion;

a second conductive portion that is tube-shaped and more flexible than the first conductive portion and includes one end portion and an other end portion, the one end portion of the second conductive portion being in contact with and electrically connected to the end portion of the first conductive portion in a state of covering an outer circumferential surface of the end portion of the first conductive portion;

a connection portion that is electrically conductive and includes an end portion, the other end portion of the second conductive portion being in contact with and electrically connected to the end portion of the connection portion in a state of covering an outer circumferential surface of the end portion of the connection portion, and includes a terminal-shaped portion capable of being connected to a partner member; and an insulating covering portion that surrounds at least the first conductive portion and the second conductive portion.

2. The electrical wire module according to claim 1, wherein the connection portion includes a first connection portion that is bar-shaped and includes a portion connected to the other end portion of the second conductive portion in a state where the outer circumferential surface is covered by the other end portion, and a second connection portion that is terminal-shaped and is formed on a side of the first connection portion that is opposite to a second conductive portion side.

3. The electrical wire module according to claim 2, wherein the connection portion is formed by processing a single-core wire that is separate from the first conductive portion, and the connection portion includes the first connection portion that is one end portion of the separate single-core wire, the second connection portion that is an other end portion of the separate single-core wire that is terminal-shaped, and an intermediate portion that is a portion other than the two end portions of the separate single-core wire and connects the first connection portion and the second connection portion.

4. The electrical wire module according to claim 3, wherein the insulating covering portion is a member in which a heat shrink tube is shrunk so as to surround the first conductive portion, the second conductive portion, and the first connection portion and the intermediate portion of the connection portion.

5. The electrical wire module according to claim 1, wherein the second conductive portion is a braided wire obtained by braiding a plurality of strands into a tubular shape.

* * * * *